US005845173A

United States Patent [19]

Zogg et al.

[11] Patent Number: 5,845,173

[45] Date of Patent: Dec. 1, 1998

[54] CONDUCTIVE ASSEMBLY FOR A DRUM IN AN IMAGE FORMING APPARATUS

[75] Inventors: Jon Peter Zogg, Chesapeake; James Richard Crickmore, Grafton; Richard Irving Stow, II, Hampton, all of Va.

[73] Assignee: Mitsubishi Chemical America, Inc., Chesapeake, Va.

[21] Appl. No.: 994,384

[22] Filed: Dec. 19, 1997

[51] Int. Cl.[6] ..... G03G 15/00; G03G 21/00

[52] U.S. Cl. ..... 399/90; 399/117; 399/159; 492/47

[58] Field of Search ..... 399/117, 116, 399/90, 159; 492/47

[56] References Cited

U.S. PATENT DOCUMENTS

| | | | |
|---|---|---|---|
| 5,576,803 | 11/1996 | Williams et al. | 399/116 |
| 5,599,265 | 2/1997 | Foltz | 492/47 |
| 5,613,931 | 3/1997 | Maty | 492/47 |
| 5,729,792 | 3/1998 | Ikehara | 399/90 |
| 5,752,136 | 5/1998 | Sanchez et al. | 399/117 |

FOREIGN PATENT DOCUMENTS

| | | |
|---|---|---|
| 05-119681 | 5/1993 | Japan . |
| 08-006438 | 1/1996 | Japan . |
| 08-095428 | 4/1996 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

An improved grounding plate or contact assembly is provided for a photosensitive drum of an image forming apparatus such as a printer or photocopier. The arrangement ensures contact between the grounding plate/contact assembly and a contact area disposed on an interior surface of the drum regardless of the rotational orientation of the grounding plate/contact assembly with respect to the drum. In a preferred form of the invention, the grounding plate includes a plurality of circumferentially spaced contact members and is mounted upon a flange which is inserted into the end of the drum. Since the circumferential spacing of the contact members is less than a length of a laser scribed contact area on the interior surface of the drum, contact between the laser scribed area or patch and one of the contact members is ensured despite variations in the rotational or angular position of the flange with respect to the drum. Additional advantages are provided by the arrangement of the radially outwardly extending contact members with respect to a radially inwardly projecting contact member (which contacts a grounding shaft) so that satisfactory contact is not diminished by deflection of the contact members as the flange is assembled onto a drum and a grounding shaft is inserted through the flange.

23 Claims, 3 Drawing Sheets

CONDUCTIVE ASSEMBLY FOR A DRUM IN AN IMAGE FORMING APPARATUS

TECHNICAL FIELD

The invention relates to image forming apparatus, and particularly to an improved contact assembly for a drum, such as a photosensitive drum, for an image forming apparatus. More particularly, the invention provides an improved grounding plate assembly for a photosensitive drum.

BACKGROUND OF THE INVENTION

Discussion of Background

Image forming apparatus, such as printers, or photocopiers, include a photosensitive member, typically in the form of a photosensitive drum. The performance of the photosensitive drum is of critical importance, since the image being produced (or reproduced) is formed and developed on the drum. The developed image is then transferred from the drum to, e.g., a sheet of paper. Typically, the drum is formed of metal such as aluminum, and the metal is anodized or coated to provide a thin dielectric layer. The drum is then coated with photogeneration and photoconduction layers over the dielectric layer.

In forming an image, an electrostatic image is formed on the drum, and that image is developed with a developing medium, such as toner. Since the image is formed electrostatically, it is extremely important that any undesired charges or built-up charges are removed, or grounded from the drum utilizing a grounding expedient. This grounding must occur despite the anodized or coated layers which can be disposed on the drum, and which act as insulators.

In a known grounding arrangement, a grounding plate is fastened to a flange which extends into one end of the photosensitive drum. The flange is secured in place with, for example, an adhesive. This flange includes two radial projections, which make contact with an inner surface of the photosensitive drum. In addition, to provide better contact, a portion of the inner surface of the photosensitive is scribed, for example, utilizing a laser. The scribing will cut through the anodized layer (or other coatings or oxidized surfaces which reduce conductivity), so that the drum can be grounded by the grounding plate. One of the radial projections of the grounding plate is aligned with this scribed patch, to thereby ensure satisfactory contact and conductivity between the photosensitive drum and the grounding plate. The grounding plate also includes an inwardly projecting contact member, which makes contact with a shaft which extends through the drum flange. The shaft is grounded, and thus, the photosensitive drum is also grounded to the shaft by way of the grounding plate.

The laser scribing can be time consuming, and therefore it is desirable to provide only a relatively small laser scribed patch. When the flange is inserted into the drum (which is currently done manually, although automated assembly might be possible), a projection of the grounding plate must be aligned with the laser scribed patch.

Prior arrangements are unsatisfactory in that the radially projecting contact element must be aligned with the scribed patch formed on the inner surface of the photosensitive drum. If a radially extending projection does not contact with the scribed portion or contact area on the interior of the drum, although a certain amount of grounding might take place, it is certainly less than optimal. As a result, the drum will not function or will provide inferior image quality. Since inferior images can result from a wide array of problems, this problem is also difficult to detect, and results in an overall perception of inferior image forming products. Thus, prior arrangements have been problematic in that they rely upon the care of the laborer in inserting the flange into the end of the drum to ensure that the contact projection of the grounding plate is aligned with the contact area of the interior surface of the drum. Moreover, even if care has been taken in aligning the contact projection of the grounding plate with the contact surface on the interior of the drum, any movement of the flange after insertion (e.g., if the flange should move before the adhesive utilized in securing the flange to the drum has cured), inferior contact can nevertheless result. The requirement to align the contact projection of the grounding plate with the contact area on the inner surface of the drum also presents a complication or obstacle to automation. If an automated insertion is to be utilized with prior grounding plate arrangements, the equipment must provide for alignment of the contact projection with the contact area (e.g., the laser scribed patch) formed on the inner surface of the drum.

SUMMARY

It is an object of the present invention to provide an improved contact assembly for an image forming apparatus.

It is another object of the invention to provide an improved assembly for grounding or removing a change from a photosensitive drum.

It is a still further object of the invention, to provide an improved contact assembly and photosensitive drum for an image forming apparatus in which the contact assembly, or grounding plate, ensures that advantageous contact is made between the grounding plate and a contact area of the interior surface of the photosensitive drum, regardless of the rotational or angular position of the flange with respect to the photosensitive drum.

The above and other objects and advantages are achieved in accordance with the present invention by providing a grounding plate assembly which includes a plurality of contact members which radially protrude from different positions about the contact assembly or grounding plate. The grounding assembly or grounding plate of the present invention is also referred to herein as a contact assembly, since, depending upon the image forming apparatus, it might also be desirable to utilize such a contact assembly to supply a charge to the photosensitive drum. However, for most image forming apparatus, the assembly is utilized for removing charges from the photosensitive drum, and thus, the contact assembly is a grounding assembly or grounding plate.

In accordance with the present invention, the circumferential spacing between any two adjacent contact members of the grounding assembly is less than the circumferential length of the contact area provided on the inner surface of the drum. As a result, regardless of the rotational position of the flange (upon which the grounding assembly is mounted) with respect to the drum when the flange is inserted, contact between the contact area of the interior surface of the drum and at least one of the contact members is ensured.

In a presently preferred form of the invention, six contact members are provided. Although the number of contact members can be reduced by increasing the circumferential length of the contact area on the interior surface of the drum, increasing the circumferential length of the contact area will slow formation of such a contact area, and thus, slow the overall manufacturing time. For example, in a presently preferred method for forming the contact area, a laser is utilized to scribe a portion of the inner surface of the photosensitive drum to provide the contact area/patch on the drum inner surface. If the area required to be scribed by the laser is increased, the time required for forming such a laser/scribed patch is also increased, thus increasing the manufacturing time and cost.

The present invention also includes a number of additional advantageous aspects relating to the positioning of the contact members. For example, in addition to the radially outwardly extending contact members, the grounding plate will also include a radially inwardly extending contact member which is utilized to make contact with the grounding shaft of the image forming apparatus. In accordance with the present invention, it has been recognized that it is desirable for each of the radially outwardly extending contact members to be circumferentially offset from this radially inwardly extending contact member, so that more reliable contact of the various elements is ensured. Further, the flange upon which the grounding plate assembly is mounted typically includes recesses which assist in allowing the flange to yield slightly so that better insertion and fit of the flange within the photosensitive drum is achieved. In accordance with the present invention, Applicants have recognized that it is desirable to provide radially extending contact members adjacent these recesses of the flange which have a greater length than the remaining contact members.

BRIEF DESCRIPTION OF THE DRAWINGS

Other objects and advantages of the present invention will become readily apparent as the same becomes better understood with reference to the following detailed description, particularly when considered in conjunction with the drawings in which.

DETAILED DESCRIPTION OF THE PREFERRED EMBODIMENTS

Figure 1:
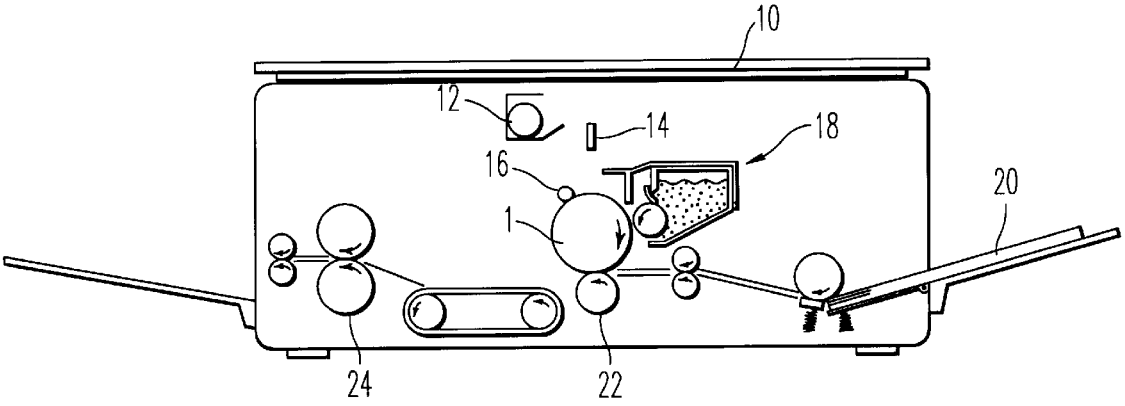
FIG. 1 schematically represents a photocopier to which the present invention is applicable.

FIG. 1 schematically represents an image forming apparatus in the form of a photocopier to which the present invention is applicable. In such an arrangement, an original document is placed upon the photocopier glass 10, and is illuminated by a lamp 12. The resulting light is then projected onto a photosensitive drum 1 by way of an optical system 14, and the drum has been previously charged utilizing, for example, a charge roller 16. As a result, an electrostatic latent image is formed on the drum 1, and this image is developed by toner of a developing unit 18, which supplies toner to the drum 1. Paper is fed from a source 20 by various rollers to a location between the drum 1 and a backup roller 22, so that the toner image of the drum is transferred to the paper. The paper is then fed to a fixing device 24 which, typically utilizing heat fixes the toner image to the paper, and the paper is then conveyed out of the apparatus. If the photosensitive drum 1 is not properly grounded, the images are not formed or are inferior in that one or more of the initial charging by charge roller 16, formation of a latent image utilizing the optical system 14, developing and/or cleaning (removal of residual toner from the drum by a cleaning device not shown) can be less than optimal. Moreover, due to the number of components of the apparatus, it can be difficult to determine the cause of inferior images. Even if the image inferiority is isolated to the photosensitive drum, the inferior images could be attributed to simple product inferiority of the drum including, for example, the materials utilized in forming the photoreceptor surface of the drum. However, inferior images can be attributable to less than optimal grounding of the photosensitive drum, but it is difficult to detect the cause of inferior images, and the user/purchaser is simply left with an overall perception of poor product quality.

Figure 2:
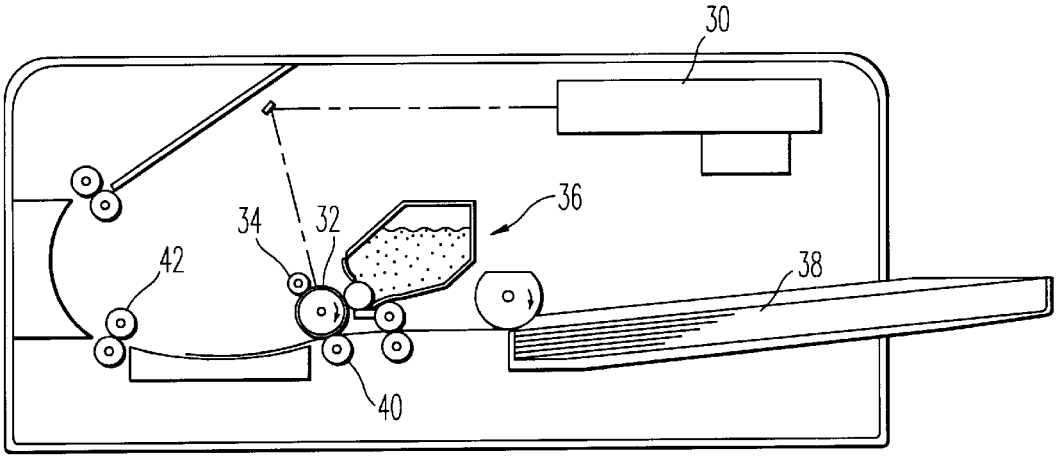
FIG. 2 schematically represents a printer to which the present invention is applicable.

FIG. 2 schematically represents a printer device to which the present invention is also applicable. As shown in FIG. 2, in contrast to the photocopier device, the printer provides an image by way of a control unit which provides a video signal, for example, by a laser scanning unit 30. The laser scanning unit 30 thus provides a latent image onto the photosensitive drum 32, which has been uniformly charged with a charge roller 34. The image is developed by a developing device 36, and is transferred to paper, which is fed from a source 38, as the paper passes between the photosensitive drum 32 and a backup roller 40. The paper then travels past a fixing device 42 and out of the printer by various conveying rollers and guides. As with the photocopying apparatus, if the photosensitive drum 32 is not properly grounded, inferior images can result, which can result in an overall perception of poor product quality.

Figure 3:
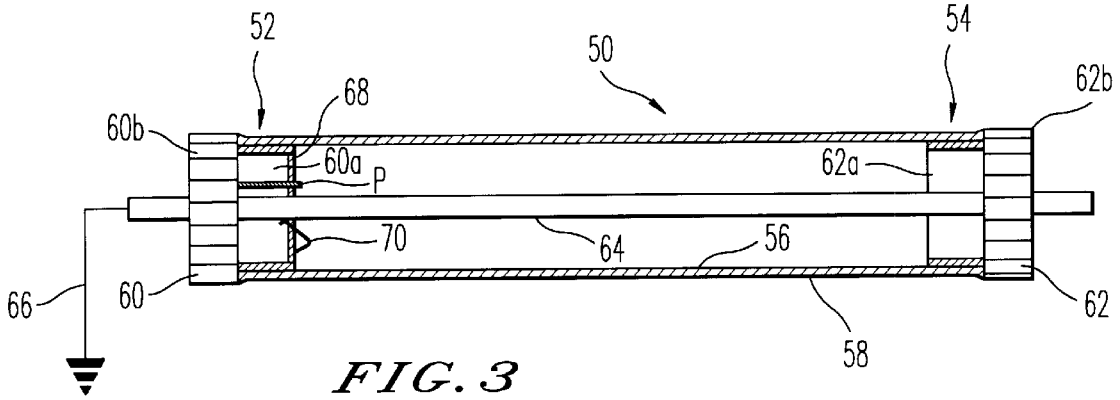
FIG. 3 is a partially cross-sectioned view of a photosensitive drum of the present invention.

Referring now to FIG. 3, a photosensitive drum assembly in accordance with the present invention is shown, in which portions of the drum and interiorly disposed portions of the drum flanges are shown in cross-section. The drum 50 is formed as a hollow tubular member having a first end 52 and a second end 54, with the drum further having an interior surface 56 and an exterior surface 58. Flanges 60, 62 are inserted into each of the first and second ends 52, 54 of the drum 50, and the flanges each include a first portion 60*a*, 62*a*, disposed inside of the drum, and a second portion 60*b*, 62*b* disposed outside of the drum. The interiorly disposed first portions 60*a*, 62*a* are fastened to the drum utilizing, for example, an adhesive, and preferably a tight fit or an interference fit is provided between the first portions 60*a*, 62*a* and the interior surface 56 of the drum 50. It is also possible to fasten or connect the flanges to the drum without an adhesive (e.g., with an interference fit). The second exteriorly disposed portions 60*b*, 62*b* typically have gear surfaces formed thereon. The gear surfaces are utilized to receive a driving force for driving the drum, and also to impart a driving force for driving other components. For example, the gear on portion 60*b* can receive a driving force from a drive gear of the image forming apparatus in order to rotate the drum 50. The gear on portion 62*b* can then be utilized to provide a driving force for other components by coupling the gear 62*b* to a drive gear of another component, such as a paper feed roller. Thus, the flange 60 can receive a driving force for rotating the drum, and the flange 62 can deliver a driving force for driving a paper feed device.

Although the gears 60*b*, 62*b* are represented as spur gears, it is to be understood that various gear configurations can be utilized, and the present invention is not limited to particular gears utilized on the flanges of the drum. It is also possible to utilize the present invention with a drum flange which does not have a gear surface formed on the flange.

The flanges 60, 62 each have an aperture extending therethrough for receiving a support shaft 64, upon which the drum 50 is rotatably mounted. Although the shaft 64 is depicted as a complete shaft, i.e., it extends completely through the drum, partial shaft arrangements are also known, in which shaft portions or pins extend through each flange and into each end of the drum, but they do not extend for the full length of the drum. The present invention can be utilized with either partial or full shaft assemblies. As schematically represented at 66, the shaft 64 is grounded, to thereby ground the photosensitive drum 50. To provide a connection between the interior surface 56 of the drum 50 and the shaft 64, a contact assembly or grounding assembly 68 is provided as will be discussed in further detail hereinafter. In the presently preferred form, the contact assembly 68 is provided as a metal (e.g., copper) grounding plate which is fastened to one of the flanges, and the flanges are formed of plastic. However, it is to be understood that various other expedients are possible. For example, the grounding/contact assembly can be formed as one piece with the flange, and portions of the contact/grounding assembly and/or flange can be formed of metal or conductive plastics. As shown in FIG. 3, in a presently preferred form, the grounding plate assembly 68 includes an inwardly projecting contact member or tongue 70, which makes contact with the shaft 64. In addition, as will become further apparent from the discussion which follows, the grounding plate assembly 68 also includes radially outwardly projecting contact members which contact the interior surface 56 of the drum 50.

Figure 4:
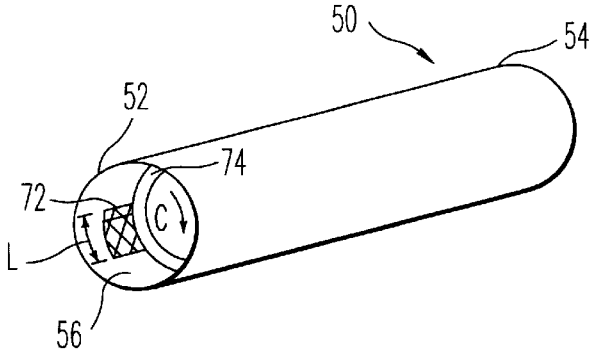
FIG. 4 is a perspective view of a photosensitive drum without flanges.

Referring briefly to FIG. 4, a perspective view of a drum 50 is shown, in which the flanges 60, 62 are removed. On the interior surface 56 of the drum, and adjacent to the first end 52, a scribed portion 72 is provided to improve the conductivity of the area 72 as compared with remaining portions of the interior of the drum. As used herein, scribed portion or contact area is intended in its broadest sense, and can encompass various expedients which will provide an area 72 having better conductivity or electrical contact as compared with other portions of the interior of the drum. In a presently preferred form of the invention, the area 72 is provided by laser scribing the patch area in order to enhance the conductivity of the area 72. However, other expedients are also possible including, for example, a mechanical scratching, chemical etching, or other treatments. Often, portions of the tube which are disposed interiorly of the ends (i.e., toward the longitudinal center of the drum) will have a reduced inner radius so that a ridge will be formed as shown at 74. This ridge or transition to a reduced inner radius of the drum can be provided to limit adhesive flow (if an adhesive is utilized) into the longitudinally interior portions of the tube to avoid any adverse effects upon the performance of the drum and/or to limit movement of the flanges upon insertion into the drum.

In the past, one or two radially protruding contact members have been provided on the grounding plate which is attached to the drum flange. When the flange is inserted into the drum, one of the contact members must be aligned, so that it is lined up with the contact area 72 of the drum. Such an arrangement is less than optimal for a number of reasons. For example, if the flange is inserted manually, the contact member of the grounding plate might not be suitably aligned as a result of inattentive labor. Further, if the contact member is properly inserted, the flange might rotate within the drum during subsequent handling. Typically, the flange is sized so that it is tightly fit into the drum, and thus, will not rotate. However, due to manufacturing variation, it is possible that a flange could rotate within the end of the drum before the adhesive utilized in securing the flange to the drum has cured.

The present invention avoids the above shortcomings. In particular, the present invention provides a series of contact members which contact the inner periphery of the drum, with the circumferential spacing between adjacent contact elements no larger than the circumferential length of the contact area 72 provided on the interior surface 56 of the drum 50. As shown in FIG. 4, the contact area 72 extends over a limited length L in the circumferential direction C of the inner circumference of the drum. Although this length L could be extended or made to extend about the entire inner periphery of the drum, the laser scribing process is time consuming, and increasing the size of the contact area would thus increase manufacturing time and costs. Moreover, providing a laser scribed portion about the entire inner circumference of the drum could also require equipment modifications in rotating the drum or laser to perform a 360° or otherwise extend the scribing operation.

Figure 5:
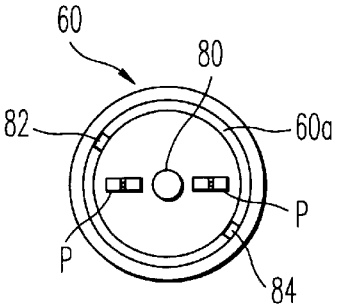
FIG. 5 is a plan view of a flange.

Referring briefly to FIG. 5, an end view of a flange (without the grounding assembly) is shown. As discussed earlier, such a flange 60 will have an aperture 80 through which a support shaft 64 can extend, and the support shaft 64 can also be utilized for grounding the photosensitive drum. The first portion 60*a* of the flange 60 which extends into the drum is often provided with recesses 82, 84 in the form of slots which extend from the longitudinally innermost end (i.e., the end of the flange which extends farthest into the drum) of the flange. These recesses 82, 84 allow the flange to be formed of a relatively rigid material, while also allowing the inner portion 60*a* of the flange to yield to allow insertion of the flange into the drum and ensure that the flange is tightly held within the drum. Projecting pins P can extend from the flange and are utilized for fastening the grounding plate to the flange (one of the pins P is also represented in FIG. 3). The pins P can be formed of the same plastic material as that of the flange, and the pins P allow the grounding plate to be properly positioned with respect to the flange utilizing apertures which are formed in the grounding plate. Once the pins P are received by apertures of the grounding plate, the head of the pins can be heated to flatten the heads of the pins, and thus prohibit removal of the grounding plate from the pins so that the grounding plate is fastened to the flange. It is to be understood, however, that other expedients are also possible for fastening or connecting the grounding plate or contact assembly of the present invention to a drum flange.

Figure 6:
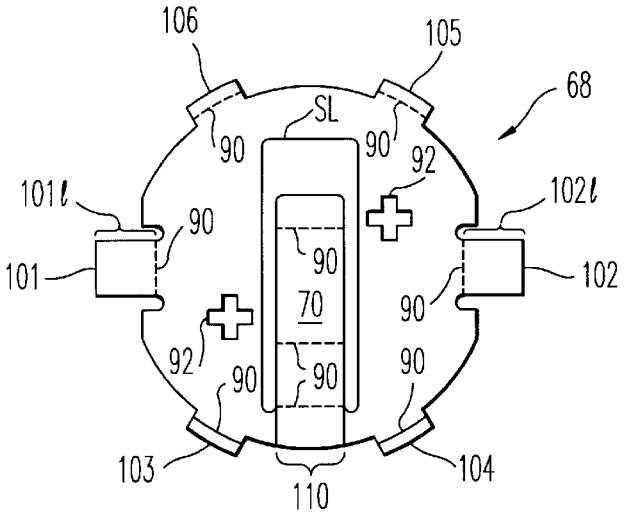
FIG. 6 depicts a grounding or contact assembly of the present invention in its "as cut" form.
Figure 7:
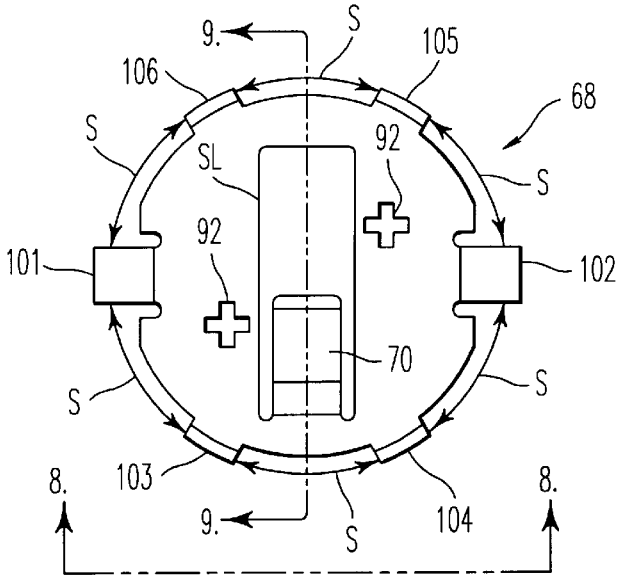
FIG. 7 illustrates a preferred form of the grounding or contact assembly of the present invention of FIG. 6 after bending.
Figure 8:
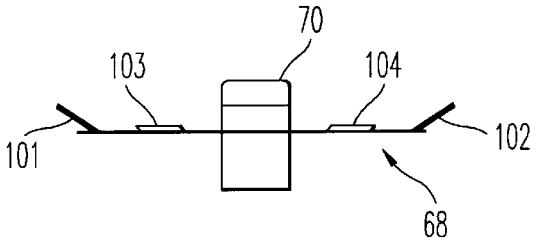
FIG. 8 is a side view of the grounding assembly along lines VIII—VIII of FIG. 7.
Figure 9:
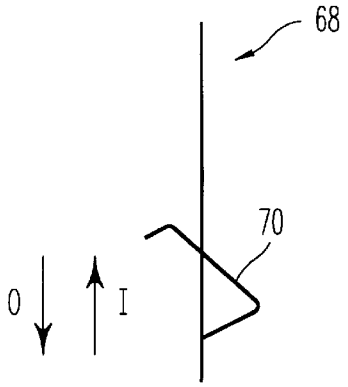
FIG. 9 is a cross-sectional view of the grounding or contact assembly along lines IX—IX of FIG. 7.

FIG. 6 illustrates a contact assembly or grounding plate of the present invention. In the presently preferred form, the grounding plate can be stamped from conductive metal sheet formed, for example, of copper or a copper alloy. FIG. 6 depicts the stamp cut form of the grounding plate assembly, i.e., in the configuration after the grounding plate is cut from sheet metal and before any shaping or bending steps. The broken lines 90 of FIG. 6 represent locations at which the grounding plate 68 is to be bent in the final forming operation. FIGS. 7–9 provide various views of the grounding plate assembly 68 after the shaping/bending operations. This shaping/bending can occur in a single stamping step, or if desired, multiple shaping operations can be performed. FIG. 7 is a plan view as shown in FIG. 6, however after the shaping/bending has taken place. FIG. 8 is a side view along line VIII—VIII of FIG. 7, and FIG. 9 is a cross-sectional view along line IX—IX of FIG. 7.

As shown in FIGS. 6 and 7, apertures 92 extend through the grounding plate 68 so that the apertures 92 can receive the pins P discussed earlier for positioning and fastening of the grounding plates to the flanges of the drum. As also discussed earlier, different fastening expedients are also possible, and it is also possible to form the grounding plate integral with or molded with the flange if desired. In the presently preferred form, six radially outwardly extending contact members 101–106 are provided, and the circumferential spacing S (FIG. 7) between any two adjacent contact members is smaller than the length L of the laser scribed patch 72 (FIG. 4). Although this can be provided by forming, for example, three or four contact members, and increasing the size of the contact members and/or increasing the size of the laser scribed patch 72, the use of six contact elements is presently preferred in that the size of the laser scribed patch need not be increased, and the contact members are of a size such that they can be bent and remain sufficiently yieldable such that they be inserted (with the flange) into an end of the drum to ensure contact with the interior surface of the drum.

As shown in FIGS. 6 and 7, a first pair 101, 102 of the contact members have a radial length larger than that of the other contact members 103–106. (The radial lengths before bending are shown at 101*l*, 102*l* in FIG. 6.) These contact members 101, 102 thus accommodate for the provision of recesses 82, 84 in the flange 60, since the flange will provide less support to the grounding plate assembly at the recess locations 82, 84. Thus, the grounding plate is able to accommodate for the possibility of additional deflection in the locations adjacent to the recesses 82, 84 of the flange. As shown in FIGS. 7 and 8, each of the contact members 101–106 is preferably bent, so that once the grounding plate is inserted into the drum, the contact member can deflect further to allow for insertion, and after insertion into the drum, the contact members 101–106 will thus be biased outwardly to ensure that they remain in contact with the interior surface of the drum. Using FIG. 8 as a reference orientation, the insertion direction into a drum would be downwardly, so that the contact members can be deflected from their FIG. 8 positions and will be biased radially outwardly to maintain contact with the inner surface of the drum.)

As also shown in FIGS. 6–9, the grounding plate 68 includes a slot SL, within which a radially inwardly extending contact member 70 is disposed. This radially inwardly extending contact member 70 can also be bent so that when the drum 50 is mounted onto the shaft 64, the radially inwardly extending contact member (or tongue) 70 can be urged or deflected radially outwardly (as represented by arrow O in FIG. 9) by the shaft 64, with the result that the tongue 70 is biased or urged in a radially inward direction (arrow I of FIG. 9) to thereby ensure that the tongue 70 is maintained in contact with the shaft 64. The tongue arrangement shown in FIGS. 6–9 is provided for a full shaft or, in other words, a shaft which extends through the entire length of the drum. However, it is to be understood that other configurations are also possible, and it is also possible to provide a tongue 70 which is not bent. For example, when used in conjunction with partial shafts or pins which extend into each end of the drum, the tongue can be substantially flat. Once the pin is inserted into the aperture of the drum flange, the pin can deflect the flat tongue, and the tongue is biased into contact with the end of the grounding pin/shaft or a side surface of the grounding pin/shaft.

As shown particularly in FIGS. 6 and 7, it will also be appreciated that each of the radially outwardly protruding contact members 101–106 is circumferentially offset from the radially inwardly extending contact member or tongue 70. In particular, each of the radially outwardly extending contact elements 101–106 is offset from the circumferential location 110 at which the tongue 70 projects radially inwardly. This aspect of the present invention has been recognized as advantageous in providing a more reliable grounding/contact assembly, despite the provision of contact members about the circumference of the grounding plate and the various stresses/deflections which can occur as the drum is assembled with the flanges. In particular, by providing the circumferentially offset arrangement, if the grounding plate is deflected or partially bent as the flange and associated grounding plate 68 are inserted into the drum 50, deflection or stress caused, for example, by the contact members 101–106 contacting the interior surface of the drum will not adversely impact or deflect the tongue 70. Similarly, the deflection caused by the tongue 70 contacting the shaft 64 will not result in an undesirable deflection of one of the contact members. If one of the radially outwardly extending contact members 101–106 were to be aligned with the tongue 70, upon insertion of the flange and grounding plate into the drum, the deflection of the contact members 101–106 could cause bending of the grounding plate so that the tongue 70 is bent or deflected and does not contact (or does not provide satisfactory contact with) the shaft 64. Thus, by offsetting the contact members 101–106 in the circumferential direction with respect to the tongue 70, a more reliable grounding plate assembly is provided.

It will thus be appreciated that the present invention provides an improved contact assembly or grounding plate for an image forming apparatus such as a printer or photocopier. The present invention is particularly advantageous in ensuring desirable contact between an interior surface of a photosensitive drum and a grounding shaft without requiring an increase in the size of the contact area in the interior surface of the drum. The present invention is particularly advantageous in that, regardless of the rotational orientation of the flange with respect to the drum (i.e., the rotational orientation about the drum axis), contact between one of the contact members and the scribed portion of the drum is assured. Thus, the present invention can make insertion more reliable if performed manually (less susceptible to error), and automated insertion can be more readily accomplished since there is no need for alignment of a contact member with the scribed patch upon insertion. The present invention is also advantageous in ensuring desirable contact between a grounding plate (or contact assembly), the interior surface of the drum, and a grounding shaft, despite various deflections or bending which can occur as a result of: (1) contact between radially outwardly extending contact members of the grounding plate and the interior surface of the drum, (2) contact between the radially inwardly extending contact member and the grounding shaft, and (3) recesses formed in the flange with which the grounding plate assembly is associated.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States:

1. A drum for an image forming apparatus comprising:

(a) a hollow tubular member having:

(i) a first end and a second end;
(ii) an interior surface and an exterior surface;
(iii) a first opening at said first end and a second opening at said second end;
(iv) a scribed portion on said interior surface at a location adjacent said first end, said scribed portion having a circumferential length extending along an inner circumference of said interior surface;

(b) a flange having:
(i) a first portion disposed in said first end of said hollow tubular member;
(ii) a grounding assembly connected to said first portion, said grounding assembly comprising:
(A) a plurality of circumferentially spaced contact members, each of which is in contact with said interior surface of said hollow tubular member, and wherein at least one of said plurality of contact members is in contact with said scribed portion; and
(B) wherein each circumferential spacing between adjacent contact members of each of said plurality of spaced contact members is smaller than said circumferential length of said scribed portion to ensure that at least one of said plurality of circumferentially spaced contact members is in contact with said scribed portion regardless of rotational orientation of said flange with respect to said hollow tubular member.

2. A drum as recited in claim 1, wherein said grounding assembly includes a conductive plate and wherein said plurality of circumferentially spaced contact members are radial protrusions of said plate, and wherein said radial protrusions are disposed at an outer periphery of said plate.

3. A drum as recited in claim 2, wherein said plurality of circumferentially spaced contact members includes at least three circumferentially spaced contact members.

4. A drum as recited in claim 3, wherein said plurality of circumferentially spaced contact members includes at least four circumferentially spaced contact members, and wherein a first pair of said plurality of circumferentially spaced contact members have a first length, and a second pair of said circumferentially spaced contact members have a second length, and wherein said first length is larger than said second length.

5. A drum as recited in claim 4, wherein said first portion of said flange includes a first recess and a second recess, and wherein one of said first pair of circumferentially spaced contact members is disposed adjacent to said first recess, and another of said first pair is disposed adjacent to said second recess.

6. A drum as recited in claim 5, wherein said plate includes a planar portion and said plurality of circumferentially spaced contact members are bent.

7. A drum as recited in claim 6, wherein said plate further includes:

(a) a slot;
(b) an inwardly protecting contact member which extends into said slot;
(c) wherein said inwardly projecting contact member projects from said planar portion at a first location; and
(d) wherein each of said plurality of circumferentially spaced contact members is circumferentially offset from said first location.

8. A drum as recited in claim 7, wherein said inwardly projecting contact member is bent.

9. A drum as recited in claim 7, wherein said flange further includes a second portion which extends out of said first end of said hollow tubular member, and wherein said second portion includes a gear surface.

10. A drum as recited in claim 9, wherein said first and second portions of said flange are plastic and said plate is metal.

11. A drum as recited in claim 1, wherein:

(a) said plurality of circumferentially spaced contact members includes first, second, third and fourth circumferentially spaced contact members;
(b) each of said first and second circumferentially spaced contact members has a length greater than a length of each of said third and fourth circumferentially spaced contact members;
(c) said first and second circumferentially spaced contact members are disposed at diametrically opposite locations;
(d) said first portion of said flange includes first and second recesses; and
(e) said first and second circumferentially spaced contact members are disposed adjacent to said first and second recesses.

12. A drum as recited in claim 11, further including:

(a) fifth and sixth circumferentially spaced contact members;
(b) wherein said third and fourth circumferentially spaced contact members are disposed at diametrically opposite locations;
(c) said fifth and sixth circumferentially spaced contact members are disposed at diametrically opposite locations; and
(d) said first and second circumferentially spaced contact members each has a length greater than a length of each of said fifth and sixth circumferentially spaced contact members.

13. A drum as recited in claim 12, wherein:

(a) said flange includes a second portion disposed outside of said hollow tubular member;
(b) a gear surface is formed on said second portion;
(c) an aperture extends through said flange for receiving a shaft member;
(d) said first and second portions of said flange are formed of plastic;
(e) said grounding assembly is formed of metal;
(f) said grounding assembly further includes an inwardly projecting contact member for contacting a shaft extending through said aperture.

14. A drum as recited in claim 13, wherein said scribed portion is a laser scribed patch.

15. An image forming apparatus which includes a drum comprising:

(a) a hollow tubular member having:
(i) a first end and a second end;
(ii) an interior surface and an exterior surface;
(iii) a first opening at said first end and a second opening at said second end;
(iv) a scribed portion on said interior surface at a location adjacent said first end, said scribed portion having a circumferential length extending along an inner circumference of said interior surface;

(b) a flange having:
(i) a first portion disposed in said first end of said hollow tubular member;
(ii) a grounding assembly connected to said first portion, said grounding assembly comprising:

(A) a plurality of circumferentially spaced contact members, each of which is in contact with said interior surface of said hollow tubular member, and wherein at least one of said plurality of contact members is in contact with said scribed portion; and (B) wherein each circumferential spacing between adjacent contact members of each of said plurality of spaced contact members is smaller than said circumferential length of said scribed portion to ensure that at least one of said plurality of circumferentially spaced contact members is in contact with said scribed portion regardless of rotational orientation of said flange with respect to said hollow tubular member.

16. An image forming apparatus as recited in claim 15, wherein:

(a) said plurality of circumferentially spaced contact members includes first, second, third and fourth contact members;

(b) said grounding assembly further includes an inwardly projecting contact member;

(c) said first, second, third and fourth contact members are each circumferentially offset from said inwardly projecting contact member.

17. An image forming apparatus as recited in claim 16, further including:

(a) a shaft which extends through said flange and which contacts said inwardly projecting contact member, and (b) said flange further includes:

(i) a second portion disposed outside of said hollow tubular member;

(ii) a gear formed on said second portion;

(iii) first and second recesses disposed in said first portion;

(iv) wherein said first and second contact members are respectively disposed adjacent to said first and second recesses and (v) wherein said first and second contact members each have a length which is greater than a length of each of said third and fourth contact members.

18. A drum for an image forming apparatus comprising:

(a) a hollow tubular member having:

(i) a first end and a second end;

(ii) a contact area formed on the interior of said hollow tubular member for providing an area for electrically coupling said hollow tubular member, said contact area disposed in a region adjacent to said first end and having a higher electrical conductivity than other portions of said region, and wherein said contact area has a length extending in a circumferential direction;

(b) a flange having:

(i) a first portion disposed in said first end of said hollow tubular member; and (ii) an electrical coupling assembly comprising:

(A) a plurality of circumferentially spaced radially protruding contact members, wherein at least one of said circumferentially spaced radially protruding contact members is in contact with said contact area, and (B) wherein a circumferential spacing between adjacent contact members of each of said plurality of contact members is less than said length of said contact area.

19. A drum as recited in claim 18, further including:

(a) an aperture extending through said flange for receiving a shaft;

(b) said electrical coupling assembly includes an inwardly protruding contact member which contacts the shaft extending through said aperture;

(c) wherein said electrical coupling assembly electrically couples said contact area of said hollow tubular member to the shaft extending through said aperture by way of at least one of said plurality of circumferentially spaced radially protruding contact members and said inwardly protruding contact member.

20. A drum as recited in claim 19, wherein:

(a) said plurality of circumferentially spaced radially protruding contact members includes first, second, third, fourth, fifth and sixth contact members; and (b) each of said plurality of circumferentially spaced radially protruding contact members is circumferentially offset from said inwardly protruding contact member.

21. A drum as recited in claim 20, wherein said contact area is a laser scribed area.

22. A drum as recited in claim 21, wherein each of said plurality of circumferentially spaced radially protruding contact members and said inwardly protruding contact member is bent.

23. A drum as recited in claim 22, wherein:

(a) said first portion of said flange includes a first recess and a second recess;

(b) said first contact member is adjacent to said first recess and said second contact member is adjacent to said second recess;

(c) each of said first and second contact members has a length greater than a length of each of said third, fourth, fifth and sixth contact members.

* * * * *